US005102331A

United States Patent [19]

Brekke et al.

[11] Patent Number: 5,102,331

[45] Date of Patent: Apr. 7, 1992

[54] RADIANT WALL OVEN WITH TEMPERATURE CONTROL

[75] Inventors: Dale J. Brekke, Plymouth, Minn.; Fred L. Fleischer, Petersburg, Tenn.

[73] Assignee: Saturn Corporation, Troy, Mich.

[21] Appl. No.: 739,149

[22] Filed: Aug. 2, 1991

[51] Int. Cl.[5] ..... F27B 9/04

[52] U.S. Cl. ..... 432/152; 432/59; 432/72; 432/147; 432/175; 34/39; 126/92 C

[58] Field of Search ..... 432/144, 147, 59, 152, 432/72, 222, 175, 176, 199; 126/91 R, 91 A, 92 R, 92 C, 92 B, 92 AC, 116 A, 116 R; 34/39, 48

[56] References Cited

U.S. PATENT DOCUMENTS 4,255,132 3/1981 Carthew ..... 432/72
4,546,553 10/1985 Best ..... 34/39
4,656,758 4/1987 Nakayama ..... 432/152
4,662,840 5/1987 Ellison ..... 432/59
4,972,606 11/1990 Stoltz ..... 432/152
4,981,434 1/1991 Arndt ..... 432/59

*Primary Examiner*—James C. Yeung
*Attorney, Agent, or Firm*—Robert M. Sigler

[57] ABSTRACT

A radiant wall oven with a heating chamber and hot air chamber separated by a radiant wall, an air heating chamber, supply and return ducts between the air heating chamber and hot air chamber and blower means for circulating hot air through the ducts is provided with a radiant wall temperature control comprising two cascaded closed loop controls. The first compares the radiant wall temperature with a first setpoint value to generate the difference as a second setpoint value for the second, which compares the temperature of the supply duct with the second setpoint value to control a heat source such as a burner. Under certain conditions, the air heating chamber is vented to atmosphere.

7 Claims, 3 Drawing Sheets

RADIANT WALL OVEN WITH TEMPERATURE CONTROL

BACKGROUND OF THE INVENTION

This invention relates to a radiant wall oven of the type used for curing painted vehicle bodies. Such an oven includes a heating chamber for the vehicle body which is separated from a hot air chamber by a radiant wall. Air is circulated between the hot air chamber and a separate air heating chamber to heat the radiant wall.

An example of a prior art radiant wall oven is shown in FIG. 1. Oven 10 comprises a heating chamber 11 separated from a hot air chamber 12 by a radiant wall 13. Air in an air heating chamber 14 is heated by a heat source 15 such as a burner and is circulated by a blower 16 from air heating chamber 14 through a supply duct 17 to hot air chamber 12 and back through return duct 18 to air heating chamber 14 for reheating. Hot air in hot air chamber 12 heats radiant wall 13 to a high temperature; and radiant wall 13 radiates heat in heating chamber 11 to heat a heating load such as a painted vehicle body.

The temperature of radiant wall 12 is controlled by a standard PID (proportional, integral, derivative) closed loop control 20 which compares a sensed control temperature signal to a predetermined setpoint value. In the prior art, the sensed control temperature signal has been obtained from a temperature sensor 21 (signal $T_1$) on the radiant wall itself or a temperature sensor 22 (signal $T_3$) in return duct 18. However, use of either of these signals in a single closed loop control is subject to time delay required for changing the temperature of the air in air heating chamber 14, conveying the new temperature air through supply duct 17 to hot air chamber 12 and heating or cooling radiant wall 13.

Such a control system is capable of maintaining a reasonably constant temperature under stable conditions; but it requires time, due to the time delays already discussed, to recover from a change in heating load in the oven. The introduction of a new vehicle body to heating chamber 11 presents a significant change in heating load to the oven and thus initiates a transition period before the radiant wall temperature is again stabilized at the desired temperature. During this transition period, the paint on the vehicle body is not exposed to the desired temperature; and the length of the transition period should be minimized for the best process control. However, attempts to decrease this transition period by increasing closed loop gain may lead to overshoot and instability in the control. The production of vehicles has become a highly competitive business in which finished surface quality is one of the features by which vehicles are judged and in which, therefore, the paint application process must be finely controlled. Due to the same competitive situation, however, there is incentive to reduce production time and thus decrease costs.

SUMMARY OF THE INVENTION

The invention comprises a temperature control for a radiant wall oven having a heating chamber, a hot air chamber, a radiant wall separating the heating chamber from the hot air chamber, an air heating chamber, a supply duct for conducting air from the air heating chamber to the hot air chamber, a return duct for conducting air from the hot air chamber to the air heating chamber and blower means for circulating hot air from the air heating chamber through the supply duct to the hot air chamber and back through the return duct to the air heating chamber for reheating.

The temperature of the radiant wall is compared in a first closed loop control with a first set point signal to provide the difference as a second setpoint signal, which is compared with the temperature in the supply duct in a second closed loop control to control a heat source in the air heating chamber In addition, the control may be further responsive to a heat source heat supply signal below a first predetermined reference and a predetermined difference between the temperature in the supply duct and the second setpoint signal greater than a second reference to override the second closed loop control means and shut off the heat source, to vent the air heating chamber to a source of cool air, or both.

DESCRIPTION OF THE PREFERRED EMBODIMENT

Figure 1:
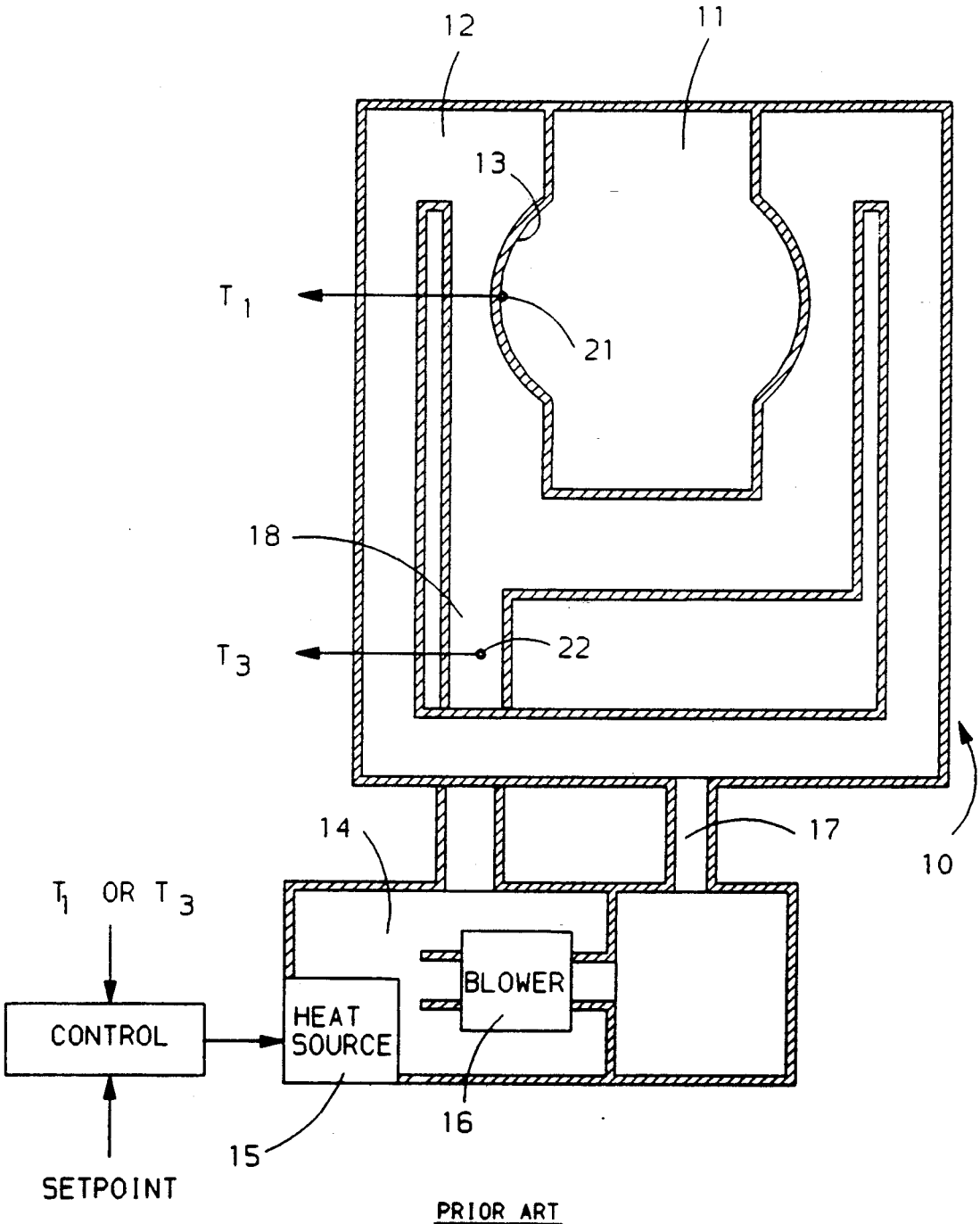
PRIOR ART FIG. 1
FIG. 1 shows a radiant wall oven and temperature control as known in the prior art.
Figure 2:
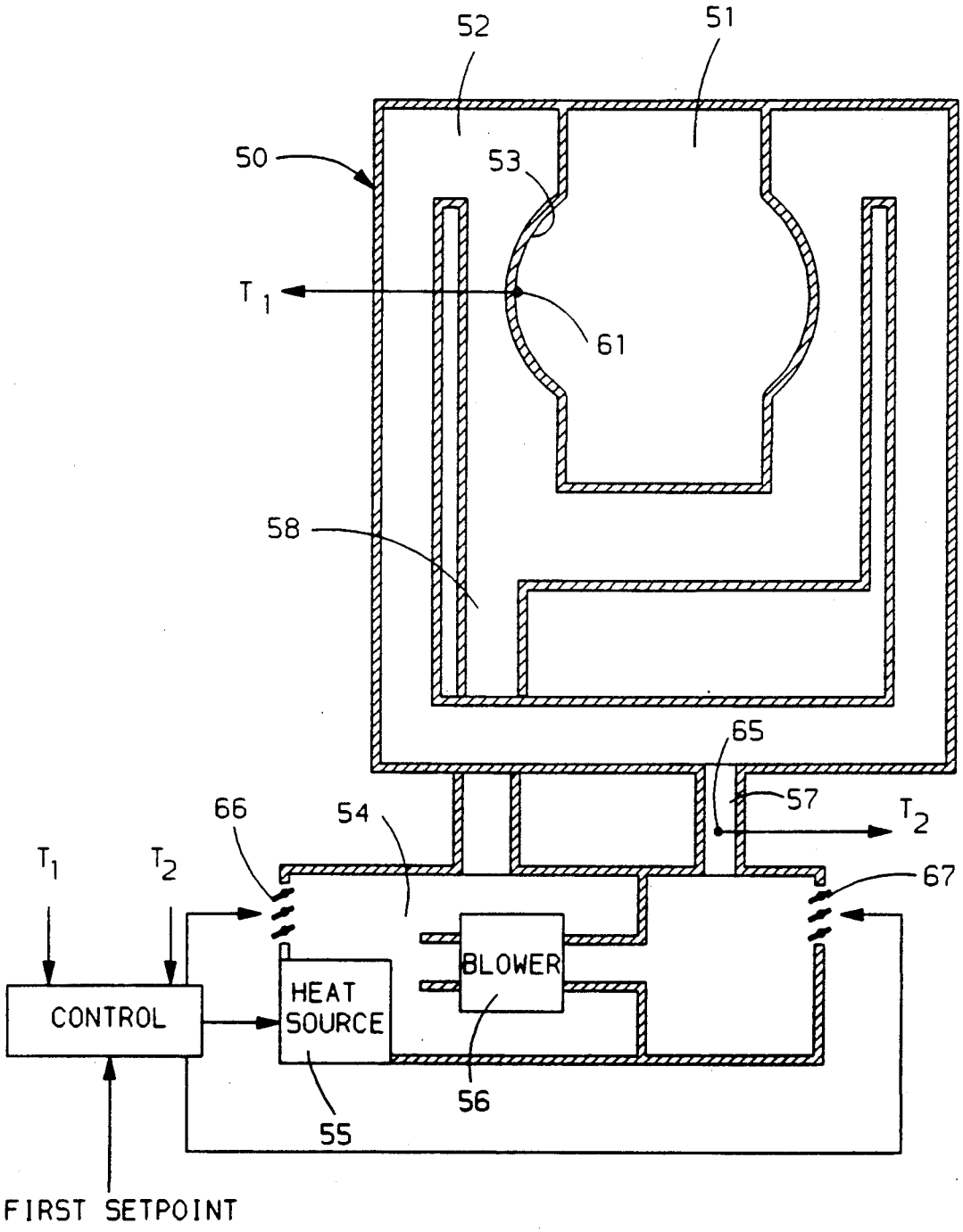
FIG. 2 shows a radiant wall oven and temperature control according to this invention.

Oven 50 of FIG. 2 is similar to the prior art oven of FIG. 1. It comprises a heating chamber 51 separated from a hot air chamber 52 by a radiant wall 53. Air in an air heating chamber 54 is heated by a heat source 55 and is circulated by a blower 56 from air heating chamber 54 through a supply duct 57 to hot air chamber 52 and back through return duct 58 to air heating chamber 54 for reheating. Hot air in hot air chamber 52 heats radiant wall 53 to a desired temperature; and radiant wall 53 radiates heat in heating chamber 51 to supply heat to a heating load such as a painted vehicle body. A temperature sensor 61 provides signal $T_1$ indicating the temperature of radiant wall 53. However, rather than a temperature sensor on return duct 58, temperature sensor 65 in supply duct 57 provides signal $T_2$ indicating the temperature of air supplied to air chamber 52. In addition, oven 50 provides louvered exhaust dampers 66 and 67 which are normally closed but which may be opened to exhaust hot air to and input cool air from the atmosphere so as to quickly cool the air supplied to air chamber 52 when necessary. Heat source 55 and dampers 66 and 67 are controlled by a cascade closed loop control 70 provided with a predetermined first setpoint signal and two control inputs.

Figure 3:
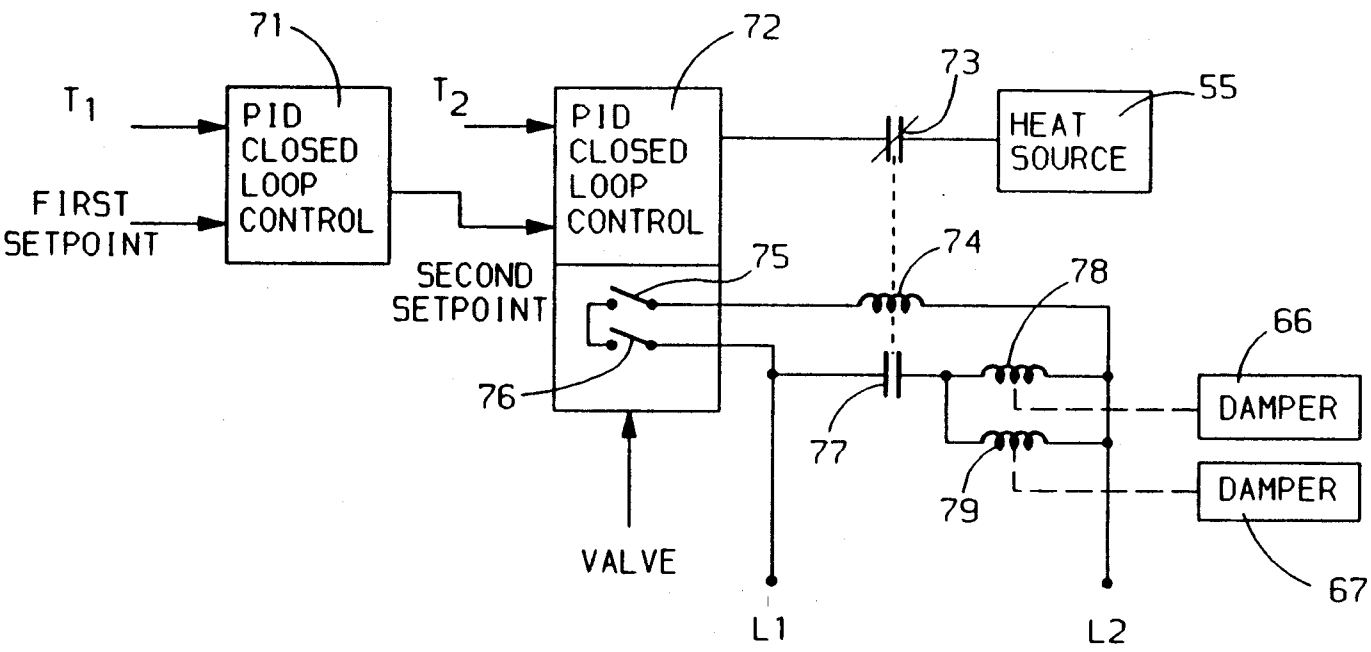
FIG. 3 shows a schematic diagram of the temperature control used with the oven of FIG. 2.

Control 70 is shown in FIG. 3. A first PID closed loop control 71 is provided with a variable input $T_1$ from the output of temperature sensor 61 and a predetermined setpoint value. The output of first PID closed loop control 71 is based on the difference between $T_1$ and the first setpoint value and comprises a second setpoint value provided to a second PID closed loop control 72, which is also provided with signal $T_2$ from temperature sensor 65 as a variable input. The output of closed loop control 72 is provided as a heat control signal through normally closed relay contacts 73 to heat source 55 to control the application of heat to the air in air heating chamber 54, such as by controlling the fuel supply valve to a burner. This control system provides specific control of the temperature of the hot air provided to radiant wall 53 and thus enables a higher gain to be used in the overall control loop for faster transient response without sacrificing stability.

The basic cascade closed loop control apparatus described above is supplemented by additional apparatus of a more discrete nature. A normally open switch 75 is caused to close in response to a VALVE signal indicating a predetermined minimal or lower fuel supply to the heat source, such as a burner fuel valve less than 1-5 percent open. Another normally open switch 76 is closed in response to a $T_2$ temperature deviation from the desired value of greater than a predetermined amount (8-20 degrees F). Switches 75 and 76 are connected in series with a relay activating coil 74 between electrical power bus lines L1 and L2. When switches 75 and 76 are both closed, coil 74 is activated to open normally closed contacts 73 to remove the heat control signal from heat source 55 and thus shut it off completely. In addition, normally open relay contacts 77 are connected between power bus lines L1 and L2 in series with a parallel pair of relay activating coils 78 and 79 provided to activate exhaust dampers 66 and 67, respectively. Normally open contacts 77 are activated closed by coil 74 as it activates normally closed contacts 73 open. Thus, when the fuel valve is essentially closed and the desired supply duct air temperature value is greatly different from the second setpoint value, dampers 66 and 67 are opened for immediate cooling.

The embodiments of the invention in which an exclusive property or privilege is claimed are defined as follows:

1. For a radiant wall oven having a heating chamber, a hot air chamber, a radiant wall separating the heating. chamber from the hot air chamber, an air heating chamber, a supply duct for conducting air from the air heating chamber to the hot air chamber, a return duct for conducting air from the hot air chamber to the air heating chamber and blower means for circulating hot air from the air heating chamber through the supply duct to the hot air chamber and back through the return duct to the air heating chamber for reheating, a radiant wall temperature control comprising, in combination:

first temperature sensing means for sensing the temperature of the radiant wall;

means for generating a first set point signal;

first closed loop control means for comparing the output of the first temperature sensing means with the first set point signal to generate a second set point signal varying with the difference therebetween;

second temperature sensing means for sensing the temperature of the air in the supply duct; and second closed loop control means for comparing the output of the second temperature sensing means with the second set point signal to control a heat source in the air heating chamber.

2. The radiant wall temperature control of claim 1 further comprising means responsive to a heat source heat supply signal below a first predetermined reference and a predetermined difference between the output of the second temperature sensing means and the second setpoint signal greater than a second reference to override the second closed loop control means and shut off the heat source.

3. The radiant wall temperature control of claim 1 further comprising means responsive to a heat source heat supply signal below a first predetermined reference and a predetermined difference between the output of the second temperature sensing means and the second setpoint signal greater than a second reference to vent the air heating chamber to a source of cool air.

4. The radiant wall temperature control of claim 3 in which the source of cool air is the atmosphere.

5. The radiant wall temperature control of claim 1 further comprising means responsive to a heat source heat supply signal below a first predetermined reference and a predetermined difference between the output of the second temperature sensing means and the second setpoint signal greater than a second reference to override the second closed loop control means and shut off the heat source and further to vent the air heating chamber to a source of cool air.

6. The radiant wall temperature control of claim 5 in which the source of cool air is the atmosphere.

7. The radiant wall temperature control of claim 5 in which the heat source is a burner provided with fuel at a controlled rate indicated by the heat source heat supply signal.

* * * * *